US010737899B2

(12) United States Patent
Mori

(10) Patent No.: US 10,737,899 B2
(45) Date of Patent: Aug. 11, 2020

(54) MEDIUM PROCESSING APPARATUS

(71) Applicant: SEIKO EPSON CORPORATION, Tokyo (JP)

(72) Inventor: Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/024,474

(22) Filed: Jun. 29, 2018

(65) Prior Publication Data

US 2019/0010008 A1 Jan. 10, 2019

(30) Foreign Application Priority Data

Jul. 4, 2017 (JP) ..... 2017-130941
Sep. 28, 2017 (JP) ..... 2017-188288

(51) Int. Cl.

*B65H 31/26* (2006.01)
*B41J 11/00* (2006.01)
*B65H 43/06* (2006.01)
*B65H 31/02* (2006.01)
*B65H 43/00* (2006.01)

(Continued)

(52) U.S. Cl.

CPC ..... *B65H 31/26* (2013.01); *B41J 11/0085* (2013.01); *B41J 11/0095* (2013.01); *B65H 29/241* (2013.01); *B65H 31/02* (2013.01); *B65H 43/00* (2013.01); *B65H 43/06* (2013.01); *B41J 13/106* (2013.01); *B65H 2301/4212* (2013.01); *B65H 2301/5305* (2013.01); *B65H 2405/11151* (2013.01); *B65H 2406/351* (2013.01); *B65H 2406/352* (2013.01); *B65H 2511/10* (2013.01); *B65H 2511/30* (2013.01); *B65H 2515/212* (2013.01); *B65H 2801/06* (2013.01)

(58) Field of Classification Search

CPC ..... B65H 9/08; B65H 9/105; B65H 29/24; B65H 29/241; B65H 29/247; B65H 31/16; B65H 31/26

See application file for complete search history.

(56) References Cited

U.S. PATENT DOCUMENTS 8,777,216 B2 * 7/2014 Otsuka ..... B65H 5/222 271/194
9,939,779 B2 * 4/2018 Fujii ..... G03G 21/206
2011/0221845 A1 9/2011 Ue (Continued)

FOREIGN PATENT DOCUMENTS

CN 102190174 9/2011
JP 05-319666 A 12/1993

(Continued)

*Primary Examiner* — Howard J Sanders
(74) *Attorney, Agent, or Firm* — Workman Nydegger

(57) ABSTRACT

A medium processing apparatus includes a processing unit that performs processing on a sheet-like medium; an outer wall on which a discharge port, from which the medium processed by the processing unit is discharged, is open; a stacking portion that has a stacking surface on which the medium discharged from the discharge port is stacked; a suction unit that sucks air on the stacking surface via a suction port provided below the discharge port; and a control unit that controls a workload of the suction unit. The control unit reduces the workload of the suction unit according to an open area of the suction port which is occluded by the medium stacked on the stacking portion and is decreased.

12 Claims, 9 Drawing Sheets

(51) Int. Cl.
*B65H 29/24* (2006.01)
*B41J 13/10* (2006.01)

(56) References Cited

U.S. PATENT DOCUMENTS

2018/0244486 A1* 8/2018 Iwano ..... B65H 31/02
2019/0025756 A1* 1/2019 Nakamoto ..... G03G 21/206

FOREIGN PATENT DOCUMENTS

JP 2002-114432 A 4/2002
JP 2005-067843 A 3/2005
JP 2007-320763 A 12/2007
JP 2015-212194 A 11/2015

* cited by examiner

MEDIUM PROCESSING APPARATUS

INCORPORATED BY REFERENCE

The entire disclosure of Japanese Patent Application Nos. 2017-130941, filed Jul. 4, 2017 and 2017-188288, filed Sep. 28, 2017 are expressly incorporated by reference herein.

BACKGROUND

1. Technical Field

The present disclosure relates to a medium processing apparatus such as a printer.

2. Related Art

As one type of a medium processing apparatus that applies processing to a medium, there is a recording apparatus that records an image such as characters or photographs on a sheet-like medium. As one example of the recording apparatus, an image forming apparatus, which discharges a recorded medium from a discharge port and stacks a medium which is discharged and falls from the discharge port on a try, is described in in JP-A-2015-212194. The image forming apparatus includes a suction unit that sucks air on the try. In the image forming apparatus, the suction unit sucks air below the medium discharged from the discharge port, so that the medium is quickly fallen toward the try and disturbance of a stacked state of the medium stacked on the try is reduced.

In such an image forming apparatus, when suction of the suction unit is too strong, there is a concern that the stacked state of the medium stacked on the try is disturbed.

SUMMARY

An advantage of some aspects of the disclosure is to provide a medium processing apparatus in which disturbance of a stacked state of a medium can be reduced.

Hereinafter, means of the disclosure and operation effects thereof will be described.

According to an aspect of the disclosure, there is provided a medium processing apparatus including: a processing unit that performs processing on a sheet-like medium; an outer wall on which a discharge port, from which the medium processed by the processing unit is discharged, is open; a stacking portion that has a stacking surface on which the medium discharged from the discharge port is stacked; a suction unit that sucks air on the stacking surface via a suction port provided below the discharge port; and a control unit that controls a workload of the suction unit. The control unit reduces the workload of the suction unit according to an open area of the suction port which is occluded by the medium stacked on the stacking portion and is decreased.

The air below the medium discharged from the discharge port is sucked by the suction unit, so that the medium is stably fallen toward the stacking portion. In this case, as the medium is stacked on the stacking portion, a part of the suction port is occluded by the medium. In a case where the suction unit is driven with a fixed workload, when a part of the suction port is occluded by the medium, since a ratio of the suction port capable of sucking the air is decreased in the suction port, a flow speed of the air passing through the suction port increases. When the flow speed of the air passing through the suction port increases, since the medium discharged from the discharge port is strongly sucked, there is a concern that a stacked state of the medium stacked on the stacking portion is led to disturbance. In this regard, according to the configuration, since the workload of the suction unit is reduced according to the open area of the suction port which is occluded by the medium stacked on the stacking portion and is decreased, it is possible to suppress that the flow speed of the air passing through the suction port increases. Therefore, it is possible to reduce the disturbance of the stacked state of the medium.

In the medium processing apparatus, it is preferable that the suction port be open to the stacking surface. According to the configuration, the air below the medium discharged from the discharge port can be suitably sucked by the suction unit from a side on which the stacking surface is positioned.

In the medium processing apparatus, it is preferable that the control unit increase the workload of the suction unit based on an increase in a stacking height of the medium stacked on the stacking portion.

Since the suction port is provided on the stacking portion, when the stacking height of the medium stacked on the stacking portion increases, it is difficult for the suction unit to suck the air below the medium discharged from the discharge port by the stacked medium. In this regard, according to the configuration, in order to increase the workload of the suction unit based on the increase in the stacking height of the medium stacked on the stacking portion, the air below the medium discharged from the discharge port can be suitably sucked by the suction unit with a large workload.

In the medium processing apparatus, it is preferable that the suction port be open to the outer wall. According to the configuration, the air below the medium discharged from the discharge port can be suitably sucked by the suction unit from a side on which the outer wall is positioned.

In the medium processing apparatus, it is preferable that the medium processing apparatus further include a side wall that extends continuously from the outer wall and the stacking portion, and the suction port be open to the side wall.

According to the configuration, the air below the medium discharged from the discharge port can be suitably sucked by the suction unit from a side on which the side wall is positioned.

In the medium processing apparatus, it is preferable that a plurality of the suction ports be provided as slit-shaped openings extending in a upward and downward direction, and the control unit reduce the workload of the suction unit according to the open area of the suction port which is decreased by occluding a part of each of the plurality of suction ports by the medium stacked on the stacking portion.

According to the configuration, since the plurality of the suction ports are provided as the slit-shaped openings extending in the upward and downward direction, it is possible to reduce a concern that the medium stacked on the stacking portion is sucked into the suction port.

In the medium processing apparatus, it is preferable that a plurality of the suction ports be provided as openings arranged in a upward and downward direction, and the control unit reduce the workload of the suction unit according to the open area of the suction port which is decreased by occluding a part of the plurality of suction ports by the medium stacked on the stacking portion.

According to the configuration, since the plurality of the suction ports are provided as openings arranged in the upward and downward direction, it is possible to reduce a concern that the medium stacked on the stacking portion is sucked into the suction port.

In the medium processing apparatus, it is preferable that the medium processing apparatus further include a detection unit capable of detecting a stacking amount of the medium stacked on the stacking portion, and the control unit change the workload of the suction unit based on detection of the detection unit.

When the stacking amount of the medium stacked on the stacking portion increases, an occluded ratio by the medium increases in the suction port. Therefore, according to the configuration, it is possible to grasp the ratio of the suction port which is occluded by the medium based on the stacking amount of the medium stacked on the stacking portion. That is, it is possible to change the workload of the suction unit according to the open area of the suction port which is occluded by the medium stacked on the stacking portion and is decreased.

In the medium processing apparatus, it is preferable that the control unit be capable of counting the number of discharged media discharged from the discharge port and change the workload of the suction unit based on the number of the discharged media.

Since the medium discharged from the discharge port is stacked on the stacking portion, when the number of the discharged media discharged from the discharge port increases, the occluded ratio by the medium increases in the suction port. Therefore, according to the configuration, it is possible to grasp the ratio of the suction port which is occluded by the medium based on the number of the discharged media discharged from the discharge port. That is, it is possible to change the workload of the suction unit according to the open area of the suction port which is occluded by the medium stacked on the stacking portion and is decreased.

In the medium processing apparatus, it is preferable that the medium processing apparatus further include a blowing unit that blows air sucked by the suction unit, and the blowing unit blow the air from above the discharge port toward the stacking surface.

According to the configuration, the blowing unit blows the air downward from above the medium discharged from the discharge port. Therefore, the medium discharged from the discharge port can be quickly fallen toward the stacking portion.

In the medium processing apparatus, it is preferable that the control unit change the workload of the suction unit based on a size of the medium discharged from the discharge port.

The suction of the suction unit may be too strong depending on the size of the medium. Therefore, for example, in a case where the size of the medium discharged from the discharge port is small as compared to the size of the medium normally used, the workload of the suction unit is reduced. That is, according to the configuration, the workload of the suction unit can be suitably controlled based on the size of the medium.

In the medium processing apparatus, it is preferable that the processing unit be a recording unit that performs recording on the medium.

According to the configuration, disturbance of the stacked state of the medium recorded by the recording unit can be reduced.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Hereinafter, a first embodiment of a recording apparatus that is an example of a medium processing apparatus will be described with reference to the drawings.

Figure 1:
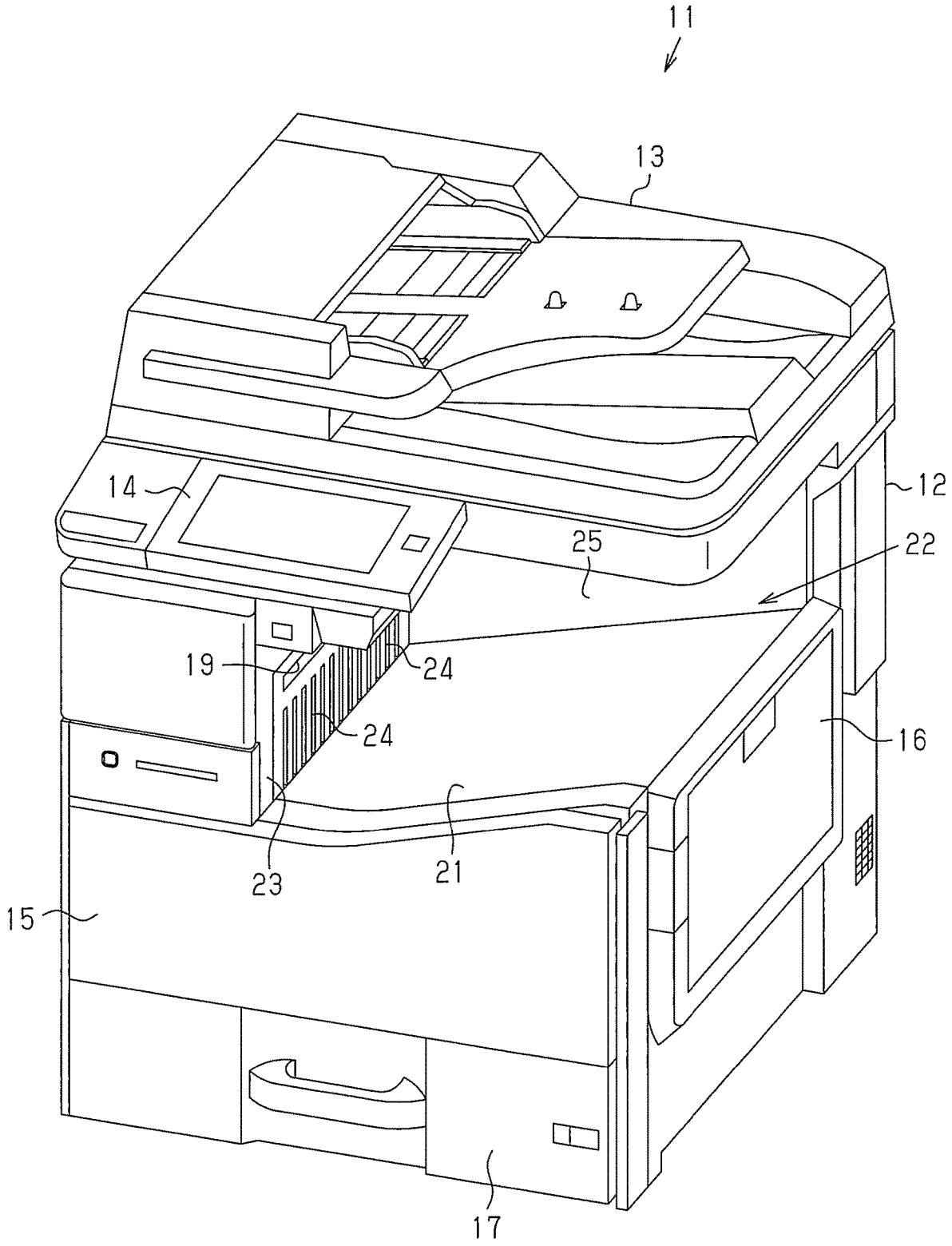
FIG. 1 is a perspective view illustrating a first embodiment of a recording apparatus that is an example of a medium processing apparatus.

As illustrated in FIG. 1, a recording apparatus 11 includes a housing 12. The recording apparatus 11 is configured to be capable of recording an image such as characters and photographs on, for example, a sheet-like medium (see FIG. 2) S such as a sheet. That is, the recording apparatus 11 is, for example, a printer. The recording apparatus 11 includes a reading mechanism 13 capable of reading a document and an operation portion 14 for operating the recording apparatus 11 above the housing 12.

The reading mechanism 13 is configured, for example, as a scanner. The operation portion 14 has, for example, a touch panel for operating the recording apparatus 11. The operation portion 14 may have operation buttons for operating the recording apparatus 11. The reading mechanism 13 and the operation portion 14 are arranged side by side so as to be adjacent to each other above the housing 12.

A direction in which the reading mechanism 13 and the operation portion 14 are arranged is a depth direction of the recording apparatus 11. In the depth direction of the recording apparatus 11, a side, on which the operation portion 14 in the reading mechanism 13 and the operation portion 14 is positioned, is a front side of the recording apparatus 11. A front surface 15 that is a surface on the front side in the housing 12 has a spread in an upward and downward direction, and a width direction of the recording apparatus 11. The depth direction, the upward and downward direction, and the width direction of the recording apparatus 11 indicate different directions respectively.

The recording apparatus 11 includes a cover 16 and a medium cassette 17. The cover 16 is attached to a side of the housing 12. That is, the cover 16 is provided on one side in the width direction of the recording apparatus 11. In the embodiment, in the width direction of the recording apparatus 11, a side on which the cover 16 is provided is a first end side and an opposite side is a second end side.

The cover 16 is capable of opening and occluding with respect to the housing 12. In FIG. 1, the cover 16 is occluded with respect to the housing 12. When the cover 16 opens with respect to the housing 12, a supply port (see FIG. 2) 18 for manually supplying the medium S on the inside of the housing 12 is exposed.

The medium cassette 17 is disposed at a lower portion of the housing 12. The medium cassette 17 is capable of attaching and detaching with respect to the housing 12 from the front side and is capable of accommodating the medium S in a stacked state. The medium cassette 17 is installed in the housing 12 in a state where the medium S is accommodated, so that the medium S is set on the inside of the housing 12. The recording apparatus 11 records an image on the medium S supplied from a supply port 18 and the medium cassette 17.

The recording apparatus 11 includes a discharge port 19 from which the recorded medium S is discharged and a stacking portion 22 which has a stacking surface 21 on which the medium S discharged from the discharge port 19 is stacked at the upper portion of the housing 12. The discharge port 19 is open to an outer wall 23 configuring a part of the housing 12. Therefore, the recording apparatus 11 includes the outer wall 23 to which the discharge port 19 is open. The outer wall 23 is a wall having a spread in the upward and downward direction, and the depth direction of the recording apparatus 11. The discharge port 19 is open at a position that is closer to an upper side of the outer wall 23.

In the outer wall 23, suction ports 24 are provided below the discharge port 19. That is, the suction ports 24 are positioned below the discharge port 19. The suction ports 24 are slit-shaped openings extending in the upward and downward direction of the recording apparatus 11. A plurality of the suction ports 24 are provided on the outer wall 23 so as to be arranged at equal intervals in the depth direction of the recording apparatus 11.

The stacking portion 22 is provided so as to configure a part of the housing 12. The stacking portion 22 is positioned below the discharge port 19. The stacking portion 22 is provided so as to extend from a lower end of the outer wall 23 toward a side (first end side) on which the cover 16 is positioned. That is, it can be said that the stacking portion 22 extends in the width direction of the recording apparatus 11 with a width of the outer wall 23 in the depth direction of the recording apparatus 11.

The stacking portion 22 has the stacking surface 21 on which the medium S discharged from the discharge port 19 is stacked. Therefore, it can be said that the stacking surface 21 has a spread in the depth direction and the width direction of the recording apparatus 11. The medium S discharged from the discharge port 19 quickly falls on the stacking portion 22 and is stacked on the stacking surface 21.

The stacking portion 22 is configured to be inclined upward from the outer wall 23 toward the cover 16 in the width direction of the recording apparatus 11. In other words, the stacking portion 22 is configured to be inclined upward from the second end side toward the first end side in the width direction of the recording apparatus 11. Therefore, the medium S discharged from the discharge port 19 moves to an outer wall 23 side so as to slide down along an inclination of the stacking surface 21 when being stacked on the stacking portion 22. Specifically, the medium S moves so as to slide down from the first end side toward the second end side in the width direction of the recording apparatus 11 on the stacking surface 21. Therefore, when the medium S is stacked on the stacking portion 22, a rear end of the medium S is in contact with the outer wall 23. That is, the rear end of the discharged medium S is in contact with the outer wall 23. Therefore, it can also be said that the outer wall 23 has a function of reducing disturbance of the stacked state of the medium S by aligning the rear ends of a plurality of the media S stacked on the stacking portion 22.

The recording apparatus 11 has a side wall 25 that extends continuously from the outer wall 23 and the stacking portion 22. The side wall 25 has a spread in the upward and downward direction, and the width direction of the recording apparatus 11. The side wall 25 is provided on a rear side of the recording apparatus 11, that is, on a back side in the depth direction of the recording apparatus 11.

The reading mechanism 13 is positioned above the stacking portion 22. The stacking portion 22 overlaps a part of the reading mechanism 13 in the upward and downward direction of the recording apparatus 11. Therefore, the stacking portion 22 is disposed in the recording apparatus 11 so as to be surrounded by the stacking surface 21 of the stacking portion 22, the outer wall 23, the side wall 25, and the reading mechanism 13. On the other hand, in the recording apparatus 11, the stacking portion 22 is open to the front side of the recording apparatus 11 and the side (first end side) of the recording apparatus 11, on which the cover 16 is provided. The recording apparatus 11 is configured to be accessible from the front side and the side (first end side) thereof with respect to the medium S stacked on the stacking portion 22.

Figure 2:
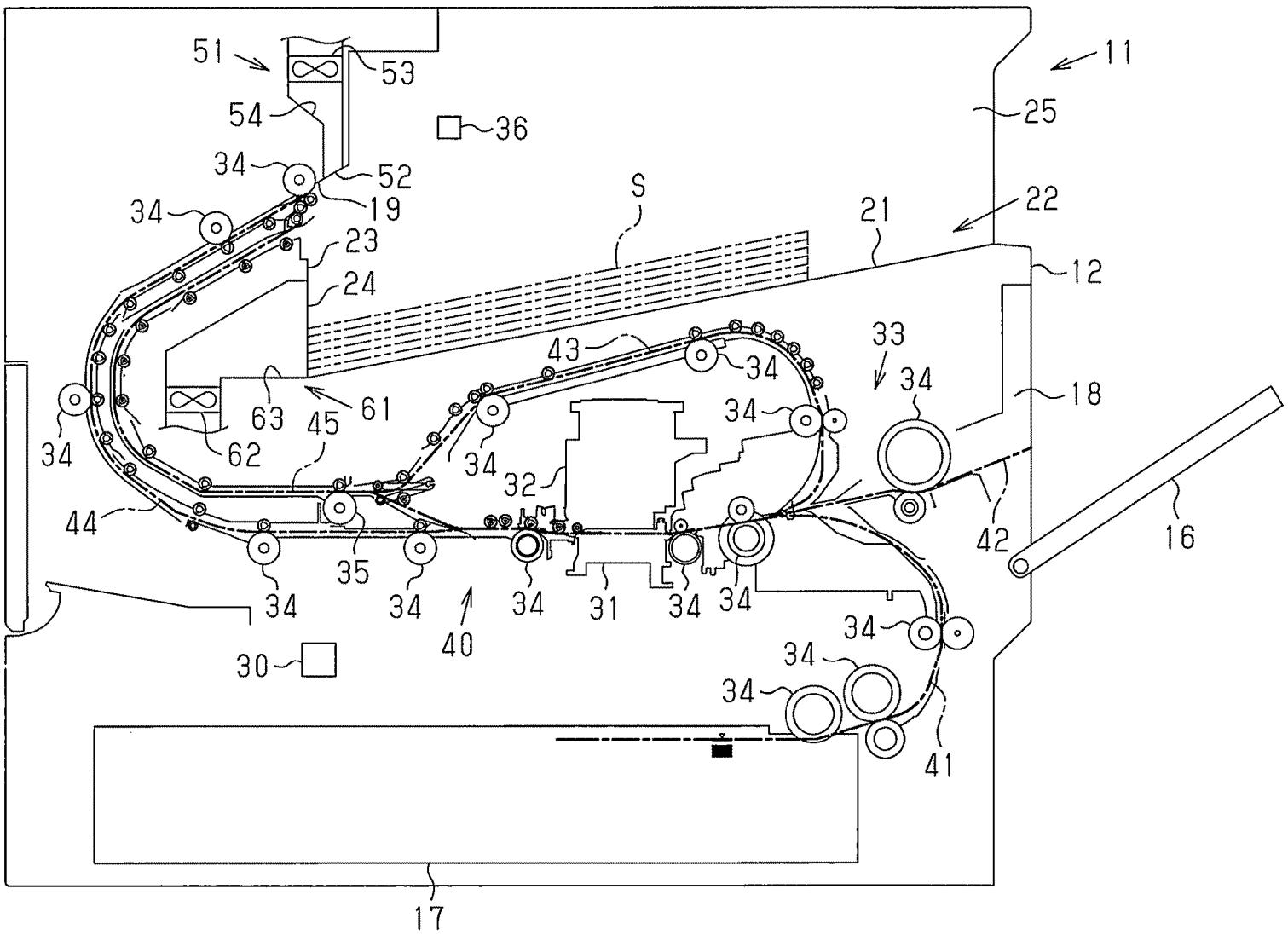
FIG. 2 is a side view illustrating an internal structure of the recording apparatus.

As illustrated in FIG. 2, the recording apparatus 11 includes a control unit 30 that controls an operation of the recording apparatus 11 in an integrated manner inside the housing 12. The recording apparatus 11 includes a recording unit 32 for recording an image on the medium S and a support table 31 for supporting the medium S being recorded by the recording unit 32 on the inside of the housing 12. The recording apparatus 11 includes the transport path 40 for transporting the medium S and a transport portion 33 for transporting the medium S along the transport path 40 on the inside of the housing 12.

The support table 31 is disposed at a position between the medium cassette 17 and the stacking portion 22 in the upward and downward direction of the recording apparatus 11. The recording unit 32 is provided above the support table 31 and is disposed so as to face the support table 31. The recording unit 32 records an image on the medium S by discharging, for example, liquid such as ink toward the medium S supported by the support table 31. That is, the recording unit 32 is an example of the processing unit that performs processing on the medium S. The transport portion 33 has a plurality of rollers 34 that are arranged along the transport path 40 and transport the medium S.

The transport path 40 has a first supply path 41, a second supply path 42, and a third supply path 43 for supplying the medium S to the recording unit 32. The transport path 40 has a discharge path 44 for discharging the medium S recorded by the recording unit 32 from the discharge port 19 and a branch path 45 branching off from the discharge path 44.

The first supply path 41 is a path through which the medium S accommodated in the medium cassette 17 is transported toward the recording unit 32. The second supply path 42 is a path through which the medium S, which is supplied from the supply port 18 exposed by opening the cover 16 attached to the side (right side in FIG. 2) of the housing 12, is transported toward the recording unit 32. The third supply path 43 is a path through which the medium S an image is recorded one surface thereof is transported again toward the recording unit 32 to execute so-called duplex printing in which images are recorded on both sides of the medium S. The third supply path 43 extends between the stacking portion 22 and the recording unit 32 so as to bypass the recording unit 32.

The discharge path 44 is a path extending from the recording unit 32 toward the discharge port 19 opening to the upper portion of the housing 12. The discharge path 44 is curved so that a posture of the transported medium S is reversed. Therefore, the medium S that is transported through the discharge path 44 is reversed so that one surface of the medium S which is recorded by the recording unit 32 is changed from an upward posture to a downward posture. The medium S discharged from the discharge port 19 falls toward the stacking portion 22 and is stacked so that recorded one surface faces the stacking surface 21.

The branch path 45 extends so as to branch from an intermediate position of the discharge path 44. The branch path 45 extends in a curved manner along the discharge path 44. The branch path 45 is connected to the third supply path 43 at an intermediate position thereof. A switchback roller 35, which is one type of the roller 34 configuring the transport portion 33 and is rotatable in both directions of a forward direction and a reverse direction, is disposed in the branch path 45.

As the switchback roller 35 rotates in the forward direction, the medium S is transported from the discharge path 44 along the branch path 45. As the switchback roller 35 rotates in the reverse direction, the medium S is reversely transported, that is, switched back from the branch path 45 toward the third supply path 43. The medium S transported through the third supply path 43 extending upward the recording unit 32 is transported while the posture thereof is reversed so that the other surface opposite to already recorded one surface faces the recording unit 32, and duplex printing is performed by the recording unit 32.

The recording apparatus 11 includes a detection unit 36 capable of detecting the stacking height of the medium S stacked on the stacking portion 22. The stacking height of the medium S stacked on the stacking portion 22 is a distance between the uppermost medium S in the plurality of the media S stacked on the stacking portion 22 and the stacking surface 21 in the upward and downward direction of the recording apparatus 11. The detection unit 36 is attached to the side wall 25. The detection unit 36 is configured as, for example, an optical sensor. The detection unit 36 detects the stacking height thereof by irradiating the medium S stacked on the stacking portion 22 with infrared rays. The control unit 30 acquires the stacking height of the medium S detected by the detection unit 36 as the stacking amount of the medium S stacked on the stacking portion 22. That is, it can be said that the detection unit 36 can detect the stacking amount of the medium S stacked on the stacking portion 22.

The detection unit 36 is not limited to the above-described mode. The detection unit 36 may sense the stacking surface 21 in the depth direction of the recording apparatus 11 by, for example, a plurality of sensors provided in the side wall 25. In this case, the detection unit 36 detects the stacking height, that is, the stacking amount of the medium S based on the number of sensors shielded by the medium S stacked on the stacking portion 22 among the plurality of the sensors. In addition, the detection unit 36 is not limited to the optical sensor, and may be configured to detect a weight of the medium S stacked on the stacking portion 22. In this case, the control unit 30 acquires the stacking amount of the medium S based on the weight of the medium S detected by the detection unit 36.

The recording apparatus 11 includes a blowing unit 51 at the upper portion of the housing 12. The blowing unit 51 can blow air via a blowing port 52 opening upward the discharge port 19. The blowing unit 51 blows air taken from the outside of the recording apparatus 11. Therefore, the air blown by the blowing unit 51 is air in the atmosphere in which the recording apparatus 11 is disposed, that is, air.

The blowing unit 51 includes a blowing fan 53 for blowing the air and a blowing flow path 54 through which the air blown by the blowing fan 53 flows. The blowing fan 53 is disposed in the blowing flow path 54. The blowing flow path 54 extends from the blowing port 52 toward the blowing fan 53. When the blowing fan 53 is driven, the air is blown from the blowing port 52.

The blowing unit 51 blows the air downward from the upper side to the medium S discharged from the discharge port 19 via the blowing port 52. The blowing unit 51 blows the air from above the discharge port 19 toward the stacking surface 21. The medium S discharged from the discharge port 19 is quickly fallen into the stacking portion 22 by being pushed against the stacking portion 22 by the air blowing from the blowing unit 51.

The recording apparatus 11 includes a suction unit 61 capable of sucking the air via the suction port 24. The air sucked by the suction unit 61 is the air in the atmosphere in which the recording apparatus 11 is disposed, that is air. The suction unit 61 includes a suction fan 62 for sucking the air and a suction flow path 63 through which the air sucked by the suction fan 62 flows.

The suction flow path 63 extends from the suction port 24 toward the suction fan 62. When the suction fan 62 is driven, the air is sucked via the suction port 24. Moreover, the suction flow path 63 and the blowing flow path 54 are connected to each other inside the housing 12. Therefore, the air outside the housing 12 sucked by the suction unit 61 is discharged to the outside of the housing 12 by the blowing unit 51. In addition, suction strength of the suction unit 61 and blowing strength of the blowing unit 51 are interlocked with each other. That is, in a case where the suction of the suction unit 61 is strong, blowing of the blowing unit 51 is also strong. In a case where the suction of the suction unit 61 is weak, blowing of the blowing unit 51 is also weak. In a case where the suction flow path 63 and the blowing flow path 54 are connected to each other, the suction fan 62 may also serve as the blowing fan 53. In addition, the blowing fan 53 may serve as the suction fan 62.

The suction unit 61 sucks the air on the stacking surface 21 via the suction port 24. Specifically, the suction unit 61 sucks the air between the discharge port 19 and the stacking surface 21. That is, the suction unit 61 sucks the air between the medium S discharged from the discharge port 19 and the stacking surface 21 when the medium S is discharged from the discharge port 19. More specifically, the air between the medium S discharged from the discharge port 19 and the stacking surface 21 is sucked from a side on which the outer wall 23 having the opened suction ports 24 is positioned.

In the recording apparatus 11 in which the medium S is discharged from the discharge port 19 and is stacked on the stacking portion 22, the stacked state of the medium S on the stacking surface 21 may be disturbed. As main factors that cause the stacked state of the medium S stacked on the stacking portion 22 to be disturbed, an air resistance generated when the medium S falls from the discharge port 19 to the stacking surface 21 and a Karman vortex generated in the medium S are considered. A falling speed of the medium S falling from the discharge port 19 toward the stacking portion 22 is lowered by the air resistance. In this case, the medium S discharged from the discharge port 19 may come into contact with the next medium S discharged from the discharge port 19 due to the falling speed of the medium S being lowered. Therefore, a falling position of the medium S is shifted and the stacked state of the medium S may be disturbed.

In the medium S falling from the discharge port 19 toward the stacking portion 22, the Karman vortex may be generated around an end portion thereof. In a case where the medium S is a rectangular sheet, the Karman vortex may be generated around ends of the sheet at four sides. In this case, the posture of the medium S discharged from the discharge port 19 may fluctuate while falling. Therefore, the falling position of the medium S is shifted and the stacked state of the medium S may be disturbed. Therefore, in the recording apparatus 11 in the embodiment, the suction unit 61 sucks the air via the suction port 24, thereby reducing the generation of the air resistance and the Karman vortex. Therefore, the medium S is quickly fallen on the stacking portion 22 and disturbance of the stacked state of the medium S is reduced.

Figure 3:
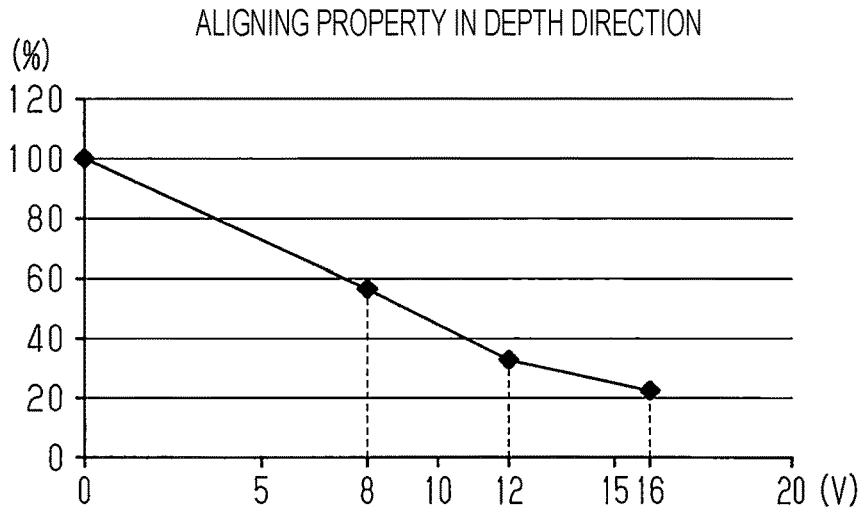
FIG. 3 is a graph illustrating an alignment property of a medium in a depth direction of the recording apparatus.
Figure 4:
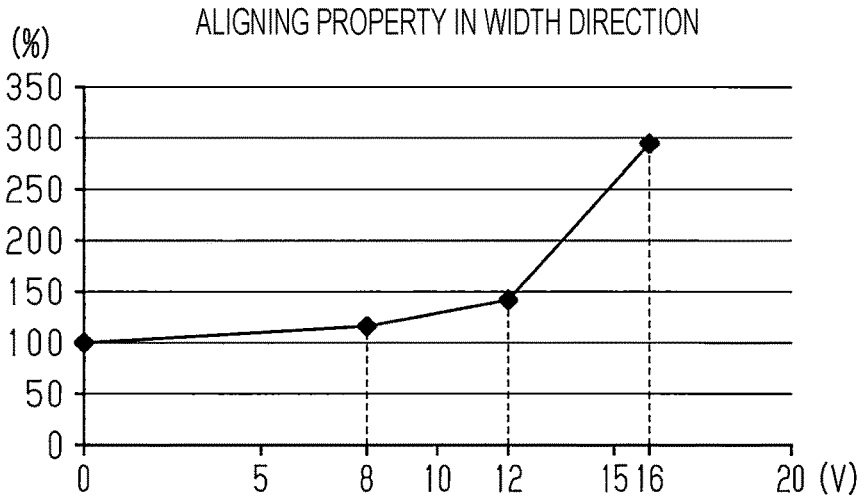
FIG. 4 is a graph illustrating an alignment property of the medium in a width direction of the recording apparatus.

Graphs illustrated in FIGS. 3 and 4 are graphs obtained by experiments. The graphs illustrate a relationship between a voltage applied to the suction fan 62 and the stacked state of the medium S stacked on the stacking portion 22, that is, the alignment property of the medium S. In the graph, a vertical axis indicates the alignment property of the medium S and a horizontal axis indicates the voltage applied to the suction fan 62. The alignment property of the medium S relatively indicates the alignment property of the medium S as 100% when there is no suction by the suction fan 62, that is, in a case where the voltage applied to the suction fan 62 is 0 V. The alignment property of the medium S indicates a state where the disturbance of the stacked state is small, that is, the alignment property of the medium S increases as a value thereof is small.

The suction unit 61 is configured such that a flow rate of the air to be sucked per unit time increases as the voltage applied to the suction fan 62 increases. In the embodiment, the flow rate of the air to be sucked per unit time by the suction unit 61 is referred to as the suction amount. The suction amount is determined by an area through which the air can pass in the suction fan 62 and a flow speed of the air passing through the suction fan 62. In the suction unit 61, since the area of the suction fan 62 through which the air can pass does not change, the fact that the suction amount of the suction unit 61 increases means that the flow speed of the air passing through the suction fan 62 increases. When the flow speed of the air passing through the suction fan 62 increases, the flow speed of the air passing through the suction port 24 also increases. That is, it can be said that the graphs illustrated in FIGS. 3 and 4 indicate the relationship between the flow speed of the air passing through the suction port 24 and the alignment property of the medium S.

The suction amount of the suction unit 61 changes as a workload of the suction unit 61 changes. When the workload of the suction unit 61 increases, the suction amount of the suction unit 61 increases. When the workload of the suction unit 61 decreases, the suction amount of the suction unit 61 decreases. The workload of the suction unit 61 is an amount of energy consumed per unit time by the suction unit 61. Therefore, the workload of the suction unit 61 is determined by performance of the suction fan 62 included in the suction unit 61 and a current flowing through the suction fan 62. It can be said that the workload of the suction unit 61 is determined by the performance of the suction fan 62 and a current applied to the suction fan 62.

The graph illustrated in FIG. 3 indicates a relationship between the voltage applied to the suction fan 62 and the alignment property of the medium S in the depth direction (direction intersecting a discharging direction of the discharged medium S) of the recording apparatus 11. When the voltage applied to the suction fan 62 is 8 V, the alignment property of the medium S in the depth direction of the recording apparatus 11 is 57%. When the voltage applied to the suction fan 62 is 12 V, the alignment property of the medium S in the depth direction of the recording apparatus 11 is 34%. When the voltage applied to the suction fan 62 is 16 V, the alignment property of the medium S in the depth direction of the recording apparatus 11 is 24%. That is, the graph indicates that as the flow speed of the air passing through the suction port 24 increases, the alignment property of the medium S in the depth direction of the recording apparatus 11 improves.

The graph illustrated in FIG. 4 indicates a relationship between the voltage applied to the suction fan 62 and the alignment property of the medium S in the width direction (discharging direction of the discharged medium S) of the recording apparatus 11. When the voltage applied to the suction fan 62 is 8 V, the alignment property of the medium S in the width direction of the recording apparatus 11 is 120%. When the voltage applied to the suction fan 62 is 12 V, the alignment property of the medium S in the width direction of the recording apparatus 11 is 140%. When the voltage applied to the suction fan 62 is 16 V, the alignment property of the medium S in the width direction of the recording apparatus 11 is 290%. That is, the graph indicates that as the flow speed of the air passing through the suction port 24 increases, the alignment property of the medium S in the width direction of the recording apparatus 11 is lowered.

In the first embodiment, since the suction unit 61 sucks the air from an outer wall 23 side, that is, from a rear end side of the medium S, the medium S moves to the suction port 24 side in the width direction of the recording apparatus 11 according to the suction. Therefore, it is considered that the alignment property of the medium S in the width direction of the recording apparatus 11 slightly deteriorates. Moreover, when the voltage applied to the suction fan 62 becomes higher than 12 V, the suction of the suction unit 61 is too strong, so that the medium S sticks to the suction port 24 and the alignment property of the medium S particularly deteriorates.

Here, the alignment property of the medium S is comprehensively evaluated by superimposing the graph illustrated in FIG. 3 and the graph illustrated in FIG. 4. For example, when the voltage applied to the suction fan 62 is 0 V, the alignment property of the medium S in the depth direction of the recording apparatus 11 is 100% and the alignment property of the medium S in the width direction of the recording apparatus 11 is 100%. The alignment property of the medium S when the voltage applied to the suction fan 62 is 0 V is evaluated as 100%+100%=200% by adding the two.

In this case, the alignment property of the medium S when the voltage applied to the suction fan 62 is 8 V is 57%+120%=177%. The alignment property of the medium S when the voltage applied to the suction fan 62 is 12 V is 34%+140%=174%. That is, it can be said that the alignment property of the medium S is improved by sucking the air by the suction unit 61 via the suction port 24. Moreover, the alignment property when the voltage applied to the suction fan 62 is 16 V is 24%+290%=314%. Therefore, when the flow speed of the air passing through the suction port 24 is too fast, conversely, the alignment property of the medium S deteriorates.

Figure 5:
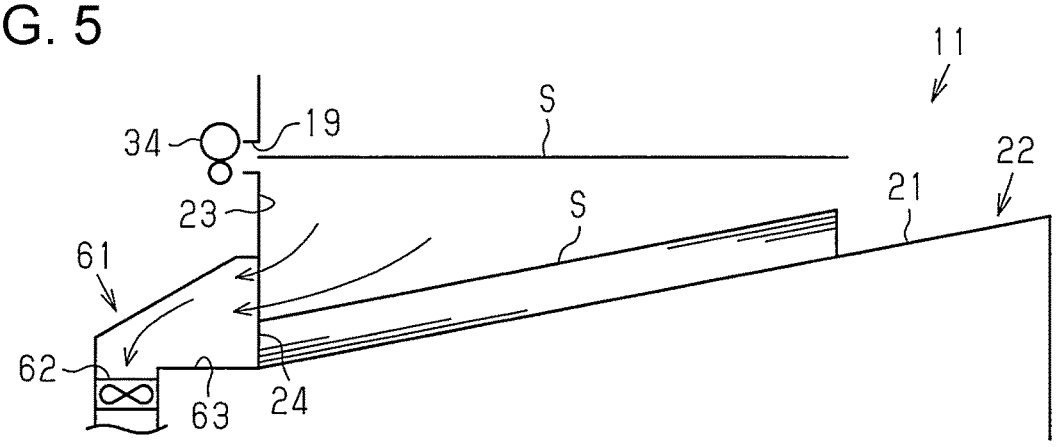
FIG. 5 is a side view schematically illustrating a stacking portion.

As illustrated in FIG. 5, the suction port 24 in the embodiment is open to the outer wall 23 with which the rear end of the medium S stacked on the stacking portion 22 comes into contact. Therefore, as the medium S is stacked on the stacking portion 22, a part of the suction port 24 is occluded by the medium S stacked on the stacking portion 22. In the embodiment, the slit-shaped suction ports 24 extending in the upward and downward direction of the recording apparatus 11 are gradually occluded by the medium S stacked on the stacking portion 22 from the lower side thereof.

When a part of the suction ports 24 is occluded, a ratio of the suction ports 24 capable of sucking the air in the suction ports 24 opening to the outer wall 23 decreases. When the ratio of the suction ports 24 capable of sucking the air decreases, the suction amount of the suction unit 61 does not change, so that the flow speed of the air passing through the suction port 24 increases. When the flow speed of the air passing through the suction port 24 increases, as described above, the alignment property of the medium S may deteriorate. Therefore, the recording apparatus 11 of the embodiment is configured so that the control unit 30 controls the suction unit 61 based on the fact that a part of the suction ports 24 is occluded by the medium S. That is, the control unit 30 controls the workload of the suction unit 61 according to the open area of the suction port 24 which is occluded by the medium S stacked on the stacking portion 22 and is decreased. The workload of the suction unit 61 is controlled by, for example, changing the voltage applied to the suction fan 62.

An operation of the recording apparatus 11 in the first embodiment configured as described above will be described. When the medium S is discharged from the discharge port 19, the control unit 30 grasps a stacking amount of the medium S stacked on the stacking portion 22 by the detection unit 36. The control unit 30 controls the suction unit 61 based on the stacking amount of the medium S detected by the detection unit 36. As described above, in the recording apparatus 11 of the first embodiment, as the stacking amount of the medium S increases, the ratio of the suction port 24 which is occluded by the medium S increases. That is, as the stacking amount of the medium S increases, the open area of the suction port 24 on the outer wall 23 decreases. Therefore, the ratio of the suction ports 24 which are occluded by the medium S in the suction ports 24 can be replaced with the stacking amount of the medium S stacked on the stacking portion 22. That is, in the first embodiment, the control unit 30 grasps the ratio of the suction ports 24 which are occluded by the medium S in the suction ports 24 based on the stacking amount of the medium S detected by the detection unit 36.

The flow speed of the air passing through the suction port 24 is determined by the suction amount of the suction unit 61 and the ratio of the suction ports 24 which are occluded by the medium S. Therefore, the control unit 30 controls the suction unit 61 based on the stacking amount of the medium S detected by the detection unit 36 so that the flow speed of the air passing through the suction port 24 does not become too fast.

The control unit 30 grasps that a part of the suction ports 24 is occluded based on the fact that the detection unit 36 detects the medium S. In the embodiment, as a part of the suction ports 24 is occluded by the medium S, the flow speed of the air sucked from the suction port 24 increases. Therefore, the control unit 30 causes the suction amount of the suction unit 61 to decrease based on the fact that a part of the suction ports 24 is occluded by the medium S. That is, the control unit 30 reduces the workload of the suction unit 61 according to the open area of the suction port 24, which is reduced by occluding a part of each of the plurality of the suction ports 24 by the medium S stacked on the stacking portion 22. For example, the voltage applied to the suction fan 62 is decreased so that the workload of the suction unit 61 is decreased.

In the first embodiment, in the control unit 30, for example, a first setting value and a second setting value are set in advance for determining the stacking amount of the medium S with three patterns of "small", "medium", and "large". The control unit 30 compares the stacking amount detected by the detection unit 36 with the first setting value and the second setting value.

In a case where the stacking amount of the medium S is smaller than the first setting value, the control unit 30 determines that the stacking amount of the medium S is "small". In this case, the control unit 30 does not change the suction amount of the suction unit 61. That is, the suction unit 61 sucks the air with a first suction amount that is set as an initial value. That is, the suction unit 61 is driven with a first workload that is set as an initial value.

In a case where the stacking amount of the medium S is larger than the first setting value and smaller than the second setting value, the control unit 30 determines that the stacking amount of the medium S is "medium". In this case, the control unit 30 reduces the suction amount of the suction unit 61 more than that when the stacking amount of the medium S is "small". That is, the suction unit 61 sucks the air with a second suction amount that is smaller than the first suction amount. That is, the suction unit 61 is driven with a second workload that is smaller than the first workload.

In a case where the stacking amount of the medium S is the second setting value or more, the control unit 30 determines that the stacking amount of the medium S is "large". In this case, the control unit 30 reduces the suction amount of the suction unit 61 more than that when the stacking amount of the medium S is "medium". That is, the suction unit 61 sucks the air with a third suction amount that is smaller than the second suction amount. That is, the suction unit 61 is driven with a third workload that is smaller than the second workload.

According to the first embodiment described above, the following effects can be obtained.

(1) The air below the medium S discharged from the discharge port 19 is sucked by the suction unit 61, so that the medium S is stably fallen toward the stacking portion 22. In this case, a part of the suction ports 24 is occluded by the medium S as the medium S is stacked on the stacking portion 22. In a case where the suction unit 61 is driven with a certain workload, when a part of the suction ports 24 is occluded by the medium S, the ratio of the suction port 24 capable of sucking the air in the suction ports 24 is reduced, so that the flow speed of the air passing through the suction port 24 increases. When the flow speed of the air passing through the suction port 24 increases, since the medium S discharged from the discharge port 19 is strongly sucked, there is a concern that the stacked state of the medium S stacked on the stacking portion 22 is led to disturbance. In this regard, according to the configuration, since the workload of the suction unit 61 is reduced according to the open area of the suction port 24 which is occluded by the medium S stacked on the stacking portion 22 and is decreased, it is possible to suppress that the flow speed of the air passing through the suction port 24 increases. Therefore, it is possible to reduce the disturbance of the stacked state of the medium S.

(2) The suction port 24 is open to the outer wall 23. Therefore, the air below the medium S discharged from the discharge port 19 can be suitably sucked by the suction unit 61 from a side on which the outer wall 23 is positioned.

(3) Since the plurality of the suction ports 24 are provided as the slit-shaped openings extending in the upward and downward direction, it is possible to reduce a concern that the medium S stacked on the stacking portion 22 is sucked into the suction port 24.

(4) The recording apparatus 11 includes the detection unit 36 capable of detecting the stacking amount of the medium S stacked on the stacking portion 22. The control unit 30 changes the workload of the suction unit 61 based on the detection of the detection unit 36. When the stacking amount of the medium S stacked on the stacking portion 22 increases, the ratio to be occluded by the medium S in the suction ports 24 increases. Therefore, the ratio of the suction port 24 which is occluded by the medium S can be grasped based on the stacking amount of the medium S stacked on the stacking portion 22. That is, it is possible to change the workload of the suction unit 61 according to the open area of the suction port 24 which is occluded by the medium S stacked on the stacking portion 22 and is decreased.

(5) The processing unit is the recording unit 32 that performs recording on the medium S. Therefore, it is possible to reduce the disturbance of the stacked state of the medium S on which recording is performed by the recording unit 32.

(6) The blowing unit 51 blows the air, which is sucked by the suction unit 61, from above the discharge port 19 toward the stacking surface 21. That is, the blowing unit 51 blows the air downward from the upper side to the medium S discharged from the discharge port 19. Therefore, the medium S discharged from the discharge port 19 can be quickly fallen toward the stacking portion 22. In addition, the blowing unit 51 blows the air sucked by the suction unit 61. Therefore, in the recording apparatus 11, a mechanism for separately taking in the air from the outside is not required for the air blown by the blowing unit 51. That is, the blowing unit 51 can be realized with a simple configuration.

Second Embodiment

Next, a second embodiment of a recording apparatus 11 will be described with reference to the drawings. In the second embodiment, points different from the first embodiment will be mainly described.

Figure 6:
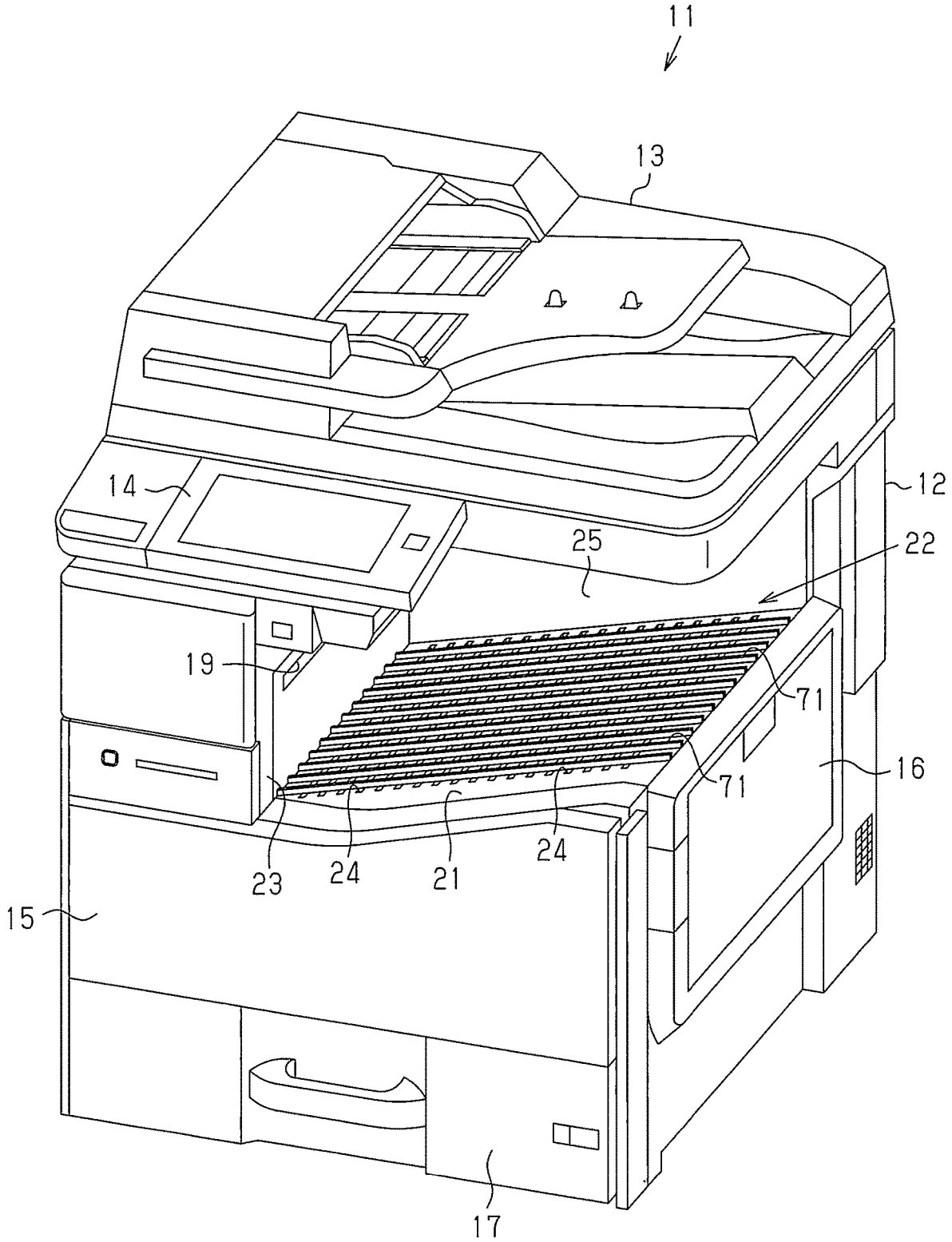
FIG. 6 is a perspective view illustrating a second embodiment of a recording apparatus.

As illustrated in FIG. 6, the recording apparatus 11 in the second embodiment is different from the recording apparatus 11 in the first embodiment in that a position at which a suction port 24 is provided is different. That is, in the recording apparatus 11 of the second embodiment, the suction port 24 is provided on a stacking surface 21 of a stacking portion 22. That is, the suction port 24 is positioned below a discharge port 19.

The suction port 24 is a slit-shaped opening extending in the depth direction of the recording apparatus 11. A plurality of the suction ports 24 are provided on the stacking surface 21 so as to be aligned in the width direction of the recording apparatus 11. The suction port 24 extends on the stacking surface 21 so as to be longer than a medium S of a maximum size capable of being recorded by the recording apparatus 11 in the depth direction of the recording apparatus 11.

The stacking portion 22 has ribs 71 extending in the width direction of the recording apparatus 11 on the stacking surface 21. A plurality of the ribs 71 are provided on the stacking surface 21 so as to be aligned in the depth direction of the recording apparatus 11. The ribs 71 extend so as to pass through above the suction ports 24 opening to the stacking surface 21. That is, the ribs 71 extends so as to cover a part of the suction ports 24. Therefore, the suction ports 24 and the ribs 71 are provided in a lattice shape on the stacking surface 21. The rib 71 is a member for preventing the medium S discharged from the discharge port 19 from falling into the suction port 24 opening to the stacking surface 21. That is, in the second embodiment, the medium S discharged from the discharge port 19 is stacked on the ribs 71.

An operation of the recording apparatus 11 in the second embodiment configured as described above will be described. A suction unit 61 in the recording apparatus 11 of the second embodiment sucks air on the stacking surface 21 via the suction ports 24. That is, the suction unit 61 sucks the air between the medium S discharged from the discharge port 19 and the stacking surface 21, downward from a side on which the stacking surface 21 is positioned. In the second embodiment, since a direction of the falling medium S and a flowing direction of the air sucked by the suction of the suction unit 61 coincide with each other, the medium S is fallen more quickly.

Figure 7:
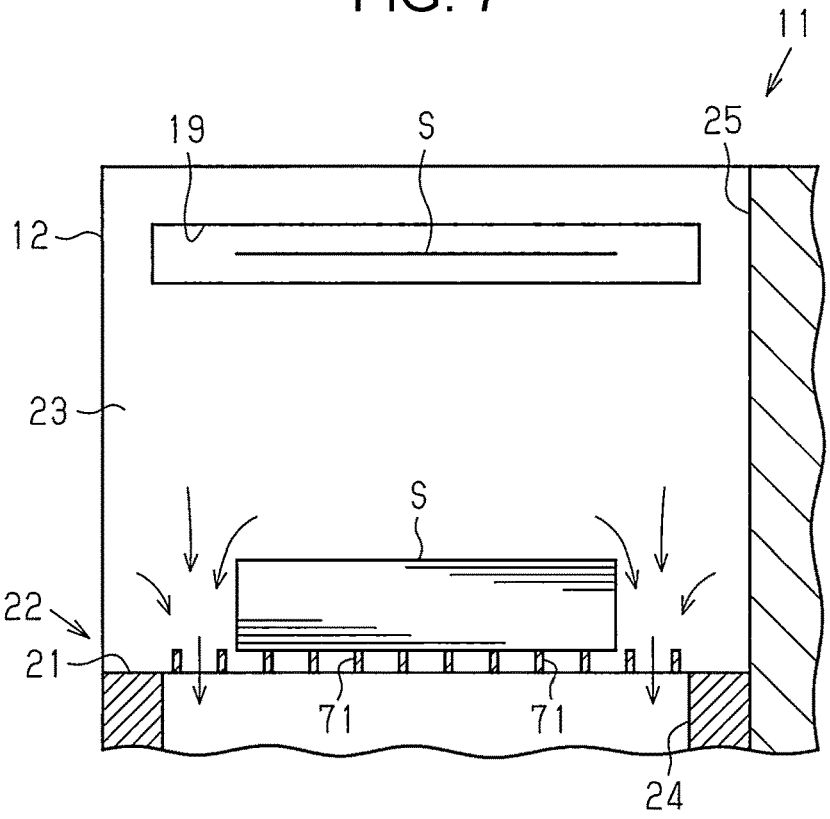
FIG. 7 is a sectional view of a stacking portion.

As illustrated in FIG. 7, when the medium S discharged from the discharge port 19 is stacked on the stacking portion 22, a part of the suction ports 24 is occluded by the medium S. In the second embodiment, the suction ports 24 open to the stacking surface 21. Therefore, in a case where the medium S is stacked from a state where the medium S is not stacked on the stacking portion 22, that is, after a first medium S is discharged from the discharge port 19, most of the area of the suction ports 24 are occluded by the first medium S. That is, the medium S is stacked on the stacking portion 22 so that the open area of the suction port 24 in the stacking surface 21 decreases.

When a part of the suction ports 24 is occluded, a ratio of the suction port 24 capable of sucking the air in the suction ports 24 opening to the stacking surface 21 decreases. When the ratio of the suction port 24 capable of sucking the air decreases, the suction amount of the suction fan 62 does not change, so that the flow speed of the air passing through the suction ports 24 increases. When the flow speed of the air passing through the suction ports 24 increases, as described above, the alignment property of the medium S may deteriorate. Therefore, the recording apparatus 11 of the embodiment is configured so that the control unit 30 controls the suction unit 61 based on the fact that a part of the suction ports 24 is occluded by the medium S.

In the second embodiment, unlike in the first embodiment, since the suction ports 24 open to the stacking surface 21, even when a second and succeeding medium S are discharged from the discharge port 19, the ratio of the occluded suction port 24 does not fluctuate greatly. That is, even when the stacking amount of the medium S stacked on the stacking portion 22 increases, the ratio of the suction port 24 which is occluded by the medium S does not greatly change.

In the second embodiment, in a case where the number of the medium S is 0 and in a case where the number of the medium S stacked on the stacking portion 22 is one or more, the ratio of the suction port 24 which is occluded by the medium S greatly changes. Therefore, in the second embodiment, in a case where there is the medium S on the stacking portion 22, the control unit 30 decreases the suction amount of the suction unit 61 compared to a case where there is no medium S on the stacking portion 22. That is, the control unit 30 reduces the suction amount of the suction unit 61 based on the fact that a part of the suction port 24 is occluded by the medium S. The control unit 30 controls the workload of the suction unit 61 according to the open area of the suction port 24 which is occluded by the medium S stacked on the stacking portion 22 and is decreased.

The control unit 30 grasps presence or absence of the medium S stacked on the stacking portion 22 by the detection unit 36. In a case where there is no medium S on the stacking portion 22, the control unit 30 does not change the suction amount of the suction unit 61. That is, the suction unit 61 sucks the air with the first suction amount which is set as the initial value. That is, the suction unit 61 is driven by the first workload that is set as the initial value.

In a case where there is the medium S on the stacking portion 22, the control unit 30 reduces the suction amount of the suction unit 61 compared to a case where there is no medium S on the stacking portion 22. That is, the suction unit 61 sucks the air with the second suction amount which is smaller than the first suction amount. That is, the suction unit 61 is driven with the second workload which is smaller than the first workload.

Figure 8:
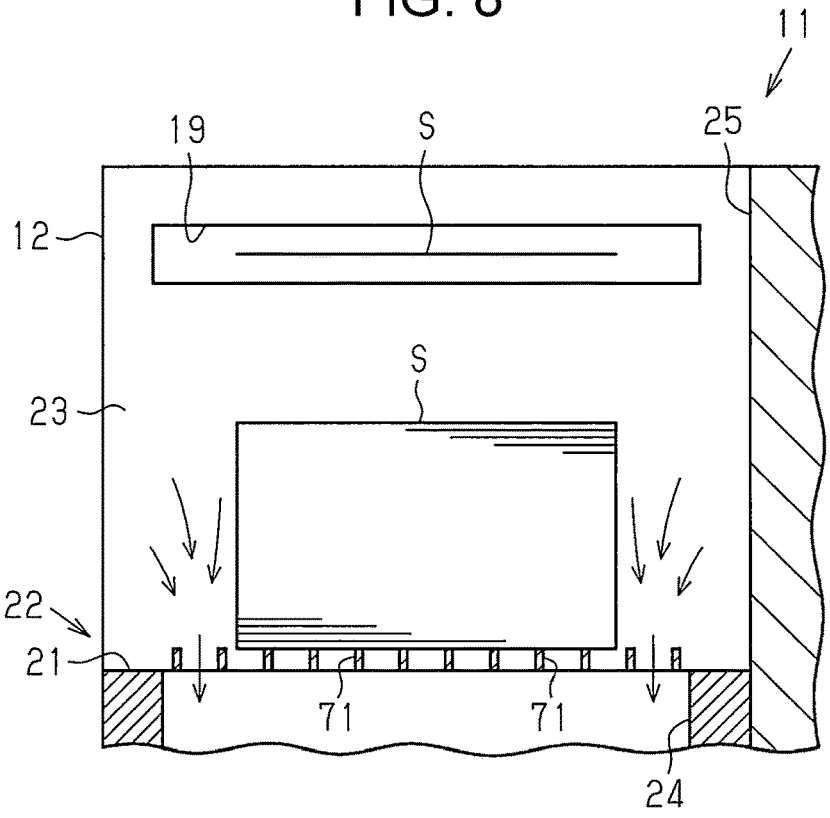
FIG. 8 is a sectional view of a stacking portion.

As illustrated in FIG. 8, in the second embodiment, when a stacking height of the medium S, that is, the stacking amount of the medium S increases, it is difficult to suck the air below the medium S discharged from the discharge port 19. Therefore, in the second embodiment, it is preferable that the control unit 30 increases the suction amount of the suction unit 61, that is, the workload of the suction unit 61 based on the fact that the stacking height of the medium S increases.

In the second embodiment, in the control unit 30, for example, a specified value is specified in advance for determining the stacking height of the medium S with two patterns of "low" and "high". The control unit 30 compares the stacking height detected by the detection unit 36 and the specified value.

The control unit 30 determines that the stacking height of the medium S is "low" in a case where the stacking height of the medium S is smaller than the specified value. In this case, the control unit 30 does not change the suction amount of the suction unit 61. That is, the suction unit 61 sucks the air with the first suction amount in a case where there is no medium S on the stacking portion 22, and sucks the air with the second suction amount in a case where there is the medium S on the stacking portion 22. That is, the suction unit 61 is driven with the first workload in a case where there is no medium S on the stacking portion 22, and is driven with the second workload in a case where there is the medium S on the stacking portion 22.

In a case where the stacking height of the medium S is the specified value of the medium S or more, the control unit 30 determines that the stacking height of the medium S is "high". In this case, the control unit 30 increases the suction amount of the suction unit 61 more than that when the stacking height of the medium S is "small". In this case, since the medium S is stacked on the stacking portion 22 at least a little, the control unit 30 causes the suction unit 61 to suck the air with the suction amount of the suction unit 61 as a fourth suction amount larger than the second suction amount. It is preferable that the fourth suction amount of is smaller than the first suction amount. That is, in a case where the stacking height of the medium S is the specified value or more, the suction unit 61 is driven with a fourth workload larger than the second workload.

In a case where the stacking height of the medium S detected by the detection unit 36 increases, the air between an uppermost medium S stacked on the stacking portion 22 and the medium S discharged from the discharge port 19 is effectively sucked by increasing the suction amount of the suction unit 61. In summary, the control unit 30 reduces the suction amount of the suction unit 61 when a second medium S is discharged. The control unit 30 increases the suction amount of the suction unit 61 as the stacking height of the medium S increases. That is, the control unit 30 changes the suction amount of the suction unit 61 based on the stacking height of the medium S. That is, the control unit 30 changes the workload of the suction unit 61 based on the stacking height of the medium S.

According to the second embodiment described above, the following effects can be obtained in addition to the effects of (1), (4), (5), and (6) in the first embodiment described above.

(7) The suction port 24 is open to the stacking surface 21. Therefore, the air below the medium S discharged from the discharge port 19 can be suitably sucked from a side on which the stacking surface 21 is positioned by the suction unit 61.

(8) The control unit 30 increases the workload of the suction unit 61 based on the fact that the stacking height of the medium S stacked on the stacking portion 22 increases. Since the suction port 24 is provided on the stacking portion 22, when the stacking height of the medium S stacked on the stacking portion 22 increases, the suction unit 61 is unlikely to suck the air below the medium S discharged from the discharge port 19 by the stacked medium S. The workload of the suction unit 61 is increased based on the fact that the stacking height of the medium S stacked on the stacking portion 22 increases. Therefore, the air below the medium S discharged from the discharge port 19 can be suitably sucked with a large workload by the suction unit 61.

Moreover, each embodiment described above may be changed as follows. In addition, the following modification examples may be appropriately combined.

Figure 9:
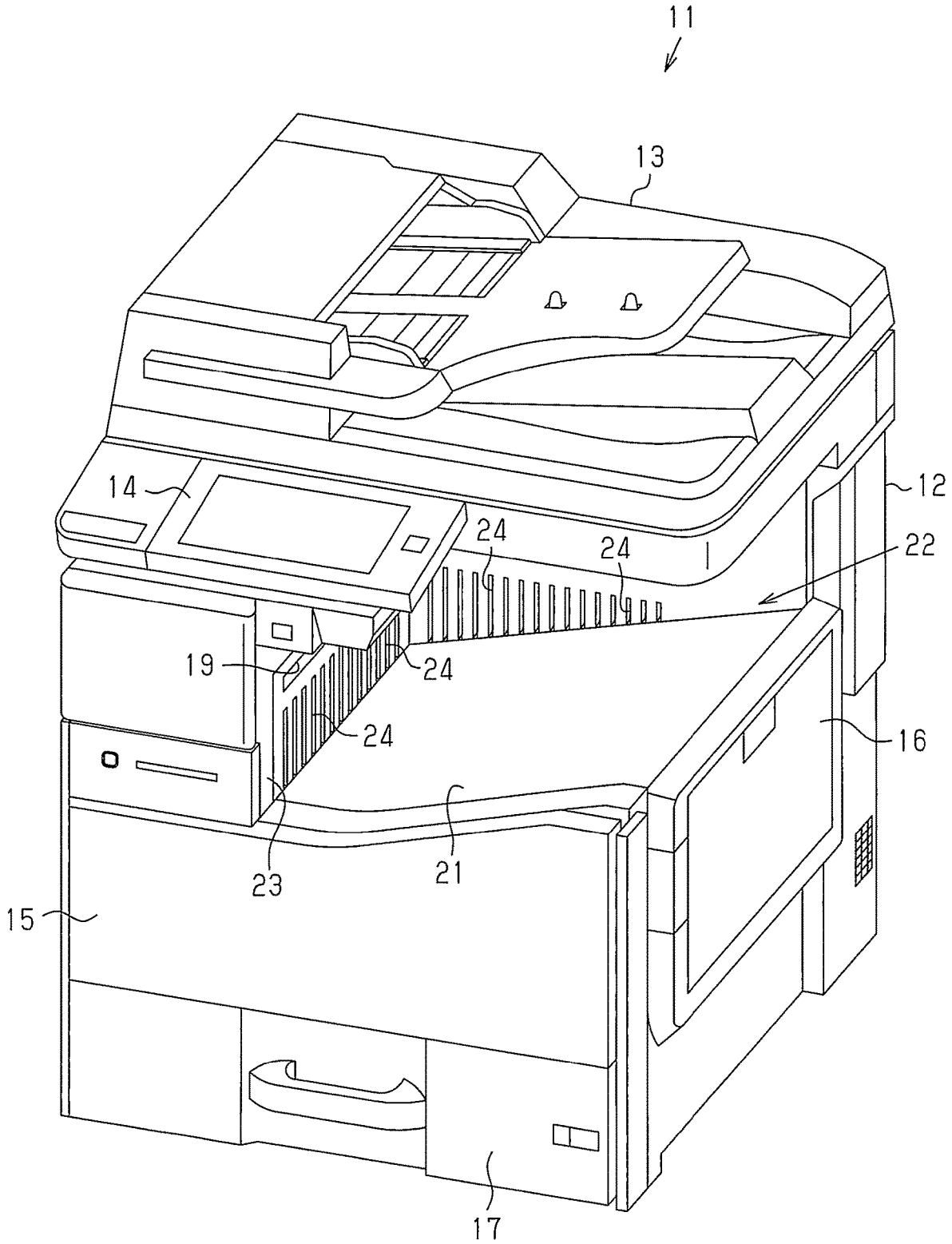
FIG. 9 is a perspective view illustrating a modification example of a recording apparatus.

As illustrated in FIG. 9, in the first embodiment, the suction ports 24 are not limited to the outer wall 23 and may open to the side wall 25. The suction ports 24 opening to the side wall 25 are positioned below the discharge port 19. The suction ports 24 opening to the side wall 25 are slit-shaped openings extending in the upward and downward direction of the recording apparatus 11. A plurality of the suction ports 24 opening to the side wall 25 are provided side by side in the width direction of the recording apparatus 11 in the side wall 25.

According to the modification example, the following effects can be obtained.

(9) The air below the medium S discharged from the discharge port 19 can be suitably sucked by the suction unit 61. In addition, since the suction ports 24 are opening to the outer wall 23 and the side wall 25, the air on the stacking surface 21 can be sucked from multiple directions, that is, the side on which the outer wall 23 is positioned and the side on which the side wall 25 is positioned. Therefore, the air on the stacking surface 21 can be uniformly sucked.

In addition, the suction ports 24 may be provided only on the side wall 25.

According to the modification example, the following effects can be obtained.

(10) The air below the medium S discharged from the discharge port 19 can be suitably sucked by the suction unit 61 from the side on which the side wall 25 is positioned.

In addition, in the modification example, the recording apparatus 11 may include a side wall facing the side wall 25 on the front side in the depth direction. The side wall extends continuously from the outer wall 23 and the stacking portion 22. The suction ports 24 may be opening to the side wall. Therefore, the air on the stacking surface 21 can be sucked from three sides. Therefore, the air on the stacking surface 21 can be uniformly sucked. Moreover, the suction ports 24 may be provided only on the side wall 25. When the suction ports 24 are provided at least one of the outer wall 23, the side wall 25, and the side wall facing the side wall 25, the air on the stacking surface 21 can be sucked.

In the first embodiment, the suction ports 24 are not limited to the outer wall 23, and may open to the stacking surface 21 as in the second embodiment. That is, the configuration of the first embodiment and the configuration of the second embodiment may be combined.

In the first embodiment, the suction ports 24 may be provided so as to extend obliquely with respect to the upward and downward direction of the recording apparatus 11.

Figure 14:
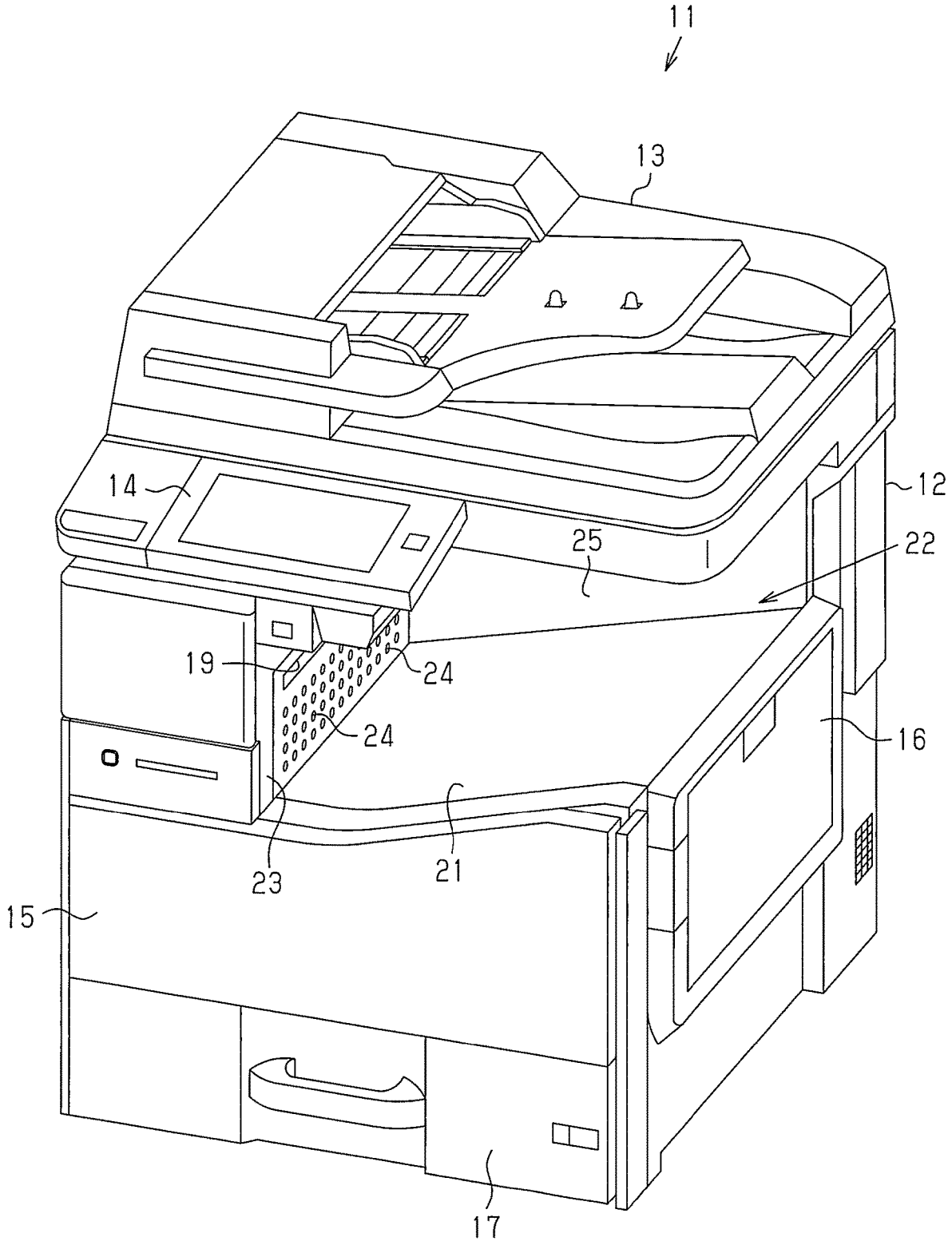
FIG. 14 is a perspective view illustrating a modification example of a recording apparatus different from those of FIGS. 9 and 10.

As illustrated in FIG. 14, in the first embodiment, a plurality of the suction ports 24 may be provided as circular-hole-shaped openings arranged in the upward and downward direction instead of the slits. A plurality of the openings are provided also in the depth direction of the recording apparatus 11 on the outer wall 23. Moreover, the circular-hole-shaped openings may be provided also on the side wall 25, or may be provided only on the side wall 25.

According to the modification example, the following effects can be obtained.

(11) Since the plurality of the suction ports 24 are provided as the openings extending in the upward and downward direction, it is possible to reduce a concern that the medium S stacked on the stacking portion 22 is sucked into the suction port 24.

Figure 10:
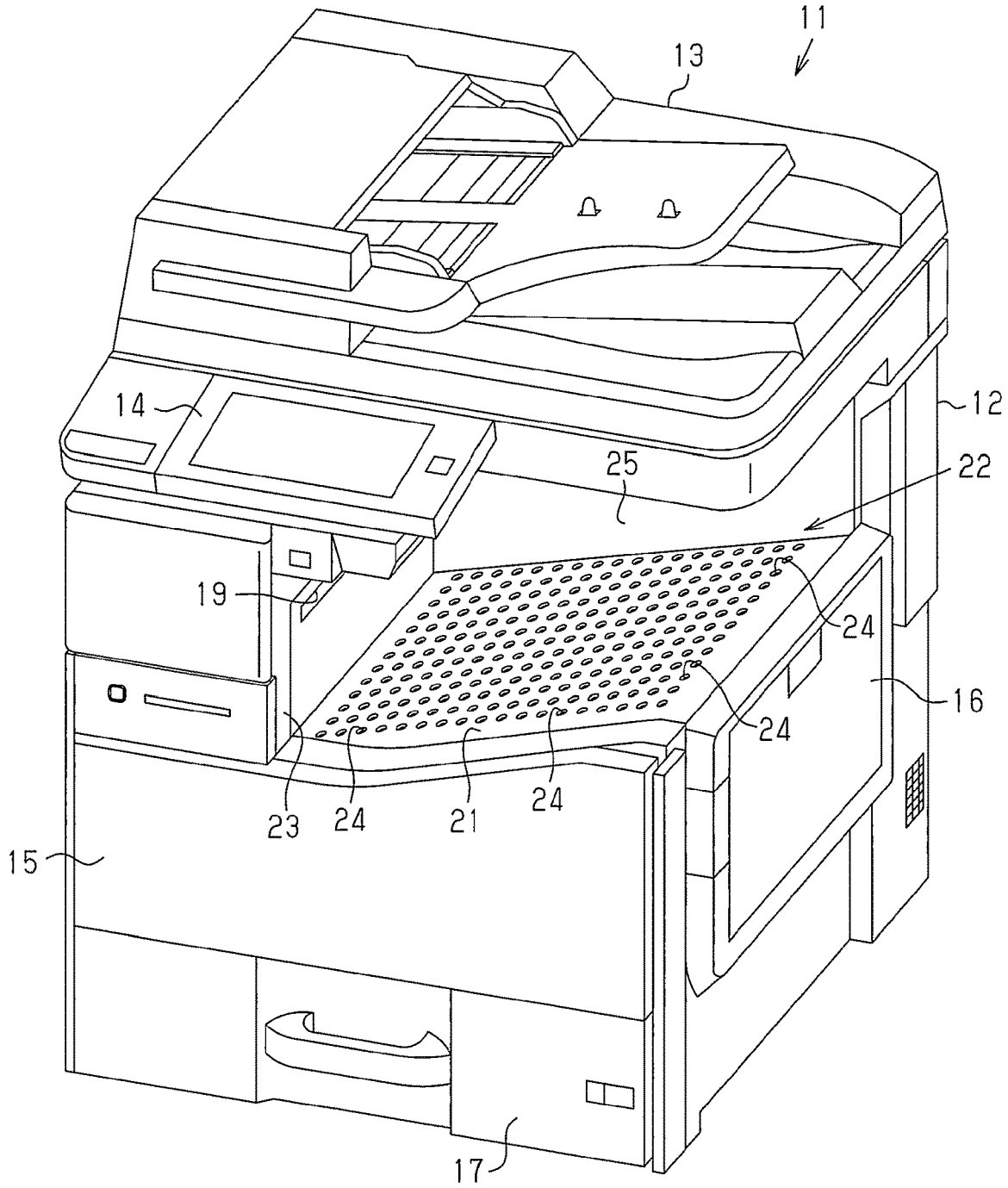
FIG. 10 is a perspective view illustrating another modification example of a recording apparatus.
Figure 11:
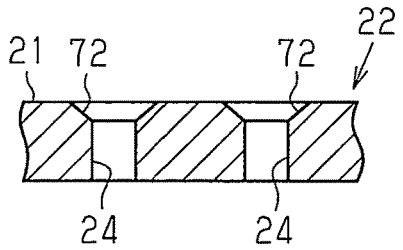
FIG. 11 is a sectional view of a part of a stacking portion in FIG. 10.

As illustrated in FIGS. 10 and 11, in the second embodiment, the suction ports 24 opening to the stacking surface 21 may be provided in a round shape. In this case, the stacking portion 22 may not have the ribs 71. A plurality of the round-shaped suction ports 24 are provided side by side at equal intervals in the depth direction and the width direction of the recording apparatus 11 on the stacking surface 21.

In the suction port 24 penetrating the stacking portion 22, a portion which is on the stacking surface 21 side is a tapered portion 72 which is inclined so as to spread toward the stacking surface 21. Therefore, even when a corner portion of the medium S discharged from the discharge port 19 enters the suction port 24, the corner portion can be scooped up by the tapered portion 72. That is, the corner portion of the medium S entered the suction port 24 can be returned to the stacking surface 21 by the tapered portion 72.

Figure 12:
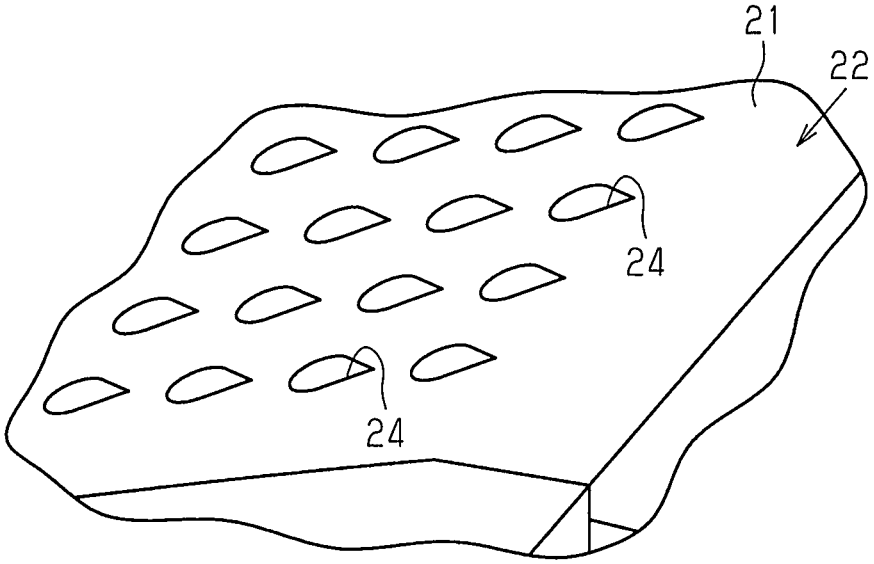
FIG. 12 is a perspective view illustrating a modification example of a suction port.

In addition, as illustrated in FIG. 12, a suction port 24 having a droplet shape may be provided instead of the round-shaped suction port 24. In this case, it is preferable that the suction port 24 is open to the stacking surface 21 so that a narrowed side in the droplet shape faces a side on which the cover 16 is positioned in the width direction of the recording apparatus 11, that is, the first end side.

Figure 13:
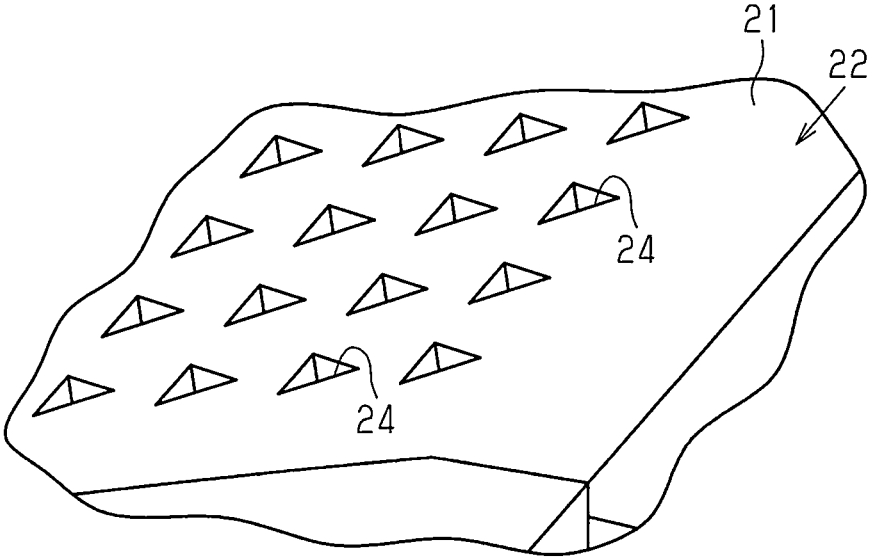
FIG. 13 is a perspective view illustrating another modification example of a suction port.

In addition, as illustrated in FIG. 13, a triangular suction port 24 may be provided instead of the round-shaped suction port 24. In this case, it is preferable that the suction port 24 is open to the stacking surface 21 so that one corner portion serving as a vertex in the triangular shape faces a side on which the cover 16 is positioned in the width direction of the recording apparatus 11, that is, the first end side.

In the second embodiment, the suction unit 61 may be configured to blow the sucked air toward the third supply path 43. In this case, the suction unit 61 blows the air from above the third supply path 43. That is, the suction unit 61 blows the air onto a surface on which an image is recorded by the recording unit 32 with respect to the medium S transported through the third supply path 43. Therefore, drying of the medium S can be promoted.

In each embodiment described above, the detection unit 36 may not be provided. In this case, the control unit 30 may count the number of the media S discharged from the discharge port 19. The control unit 30 may control the suction unit 61 based on the count number. The control unit 30 grasps the stacking amount of the medium S stacked on the stacking portion 22 and grasps the ratio of the suction port 24 which is occluded by the medium S in the suction ports 24 based on the count number. That is, based on the count number, the control unit 30 grasps the stacking amount of the medium S stacked on the stacking portion 22 and controls the workload of the suction unit 61 according to the open area of the suction port 24 which is occluded by the medium S stacked on the stacking portion 22 and is decreased.

According to the modification example, the following effects can be obtained.

(12) Since the medium S discharged from the discharge port 19 is stacked on the stacking portion 22, when the number of the discharged media S discharged from the discharge port 19 increases, the occluded ratio by the medium S increases in the suction port 24. Therefore, according to the modification example, the ratio of the suction port 24 which is occluded by the medium S can be grasped based on the number of the discharged media S discharged from the discharge port 19. That is, it is possible to change the workload of the suction unit 61 according to the open area of the suction port 24 which is occluded by the medium S stacked on the stacking portion 22 and is decreased.

In each embodiment described above, the control unit 30 may change the suction amount of the suction unit 61 based on the size of the medium S discharged from the discharge port 19. For example, when the air is sucked with the first suction amount set as the initial value, in a case where a small size medium S is discharged from the discharge port 19, the suction may be too strong. When the suction is too strong, there is a concern that the alignment property of the medium S stacked on the stacking portion 22 deteriorates. The control unit 30 controls the suction unit 61 based on the size of the medium S. Specifically, in a case where the size of the medium S discharged from the discharge port 19 is smaller than the size of the medium S which is normally used, the control unit 30 reduces the suction amount of the suction unit 61.

According to the modification example, the following effects can be obtained.

(13) The suction by the suction unit 61 may be too strong by the size of the medium S. Therefore, for example, in a case where the size of the medium S discharged from the discharge port 19 is small compared to the size of the medium S which is normally used, the workload of the suction unit 61 is reduced. That is, according to the configuration described above, the workload of the suction unit 61 can be appropriately controlled based on the size of the medium S.

In each embodiment described above, the suction flow path 63 and the blowing flow path 54 may not be connected to each other. In this case, the suction flow path 63 may be configured to extend so that the air sucked via the suction port 24 is blown onto a substrate or the like included in the recording apparatus 11. That is, the air sucked by the suction unit 61 may be used for cooling members configuring the recording apparatus 11. In addition, the air sucked by the suction unit 61 may be simply discharged to the outside of the housing 12.

In each embodiment described above, the blowing unit 51 may not be provided.

In each embodiment described above, the stacking surface 21 of the stacking portion 22 may extend horizontally.

In each embodiment described above, the control unit 30 may linearly control the suction amount of the suction unit 61 based on the stacking amount of the medium S stacked on the stacking portion 22.

In each embodiment described above, the processing unit is not limited to the recording unit 32 that performs recording an image on the medium S. For example, the processing unit performing processing on the medium S may be a cutting portion that cuts a desired size of the medium S, or may be a reading portion that reads an image of the medium S. That is, the medium processing apparatus is not limited to the recording apparatus 11 and may be a cutting apparatus or may be a reading apparatus. The configuration of each embodiment described above can be adopted as long as it is an apparatus that performs processing on the medium S.

In each embodiment described above, the medium S is not limited to a sheet and may be a plastic film, a metal film, cloth, or the like.

In each embodiment described above, the recording apparatus 11 may be a fluid ejecting apparatus which performs recording by ejecting or discharging a fluid (including a liquid, a liquid body in which particles of a functional material is dispersed or mixed in a liquid, a fluid body such as a gel, a solid body which can flow to be ejected as a fluid) other than ink. For example, the recording apparatus 11 may be a liquid body ejecting apparatus which performs recording by ejecting the liquid body containing a form obtained by dispersing or dissolving a material such as an electrode material or a color material (pixel material) used for production of liquid crystal display, electroluminescence (EL) display, surface emitting display, and the like. In addition, the recording apparatus 11 may be a fluid body ejecting apparatus which ejects a fluid body such as a gel (for example, a physical gel) or a powdery particle body ejecting apparatus (for example, a toner jet recording apparatus) which ejects a solid body such as a powder body (powdery particle body) such as toner. The present disclosure can be applied to any one of the fluid ejecting apparatuses. In the present specification, the term "fluid" includes, for example, a liquid (including an inorganic solvent, an organic solvent, a solution, a liquid resin, a liquid metal (metal melt), and the like), a liquid body, a fluid body, a powder body (powdery particle body), and the like.

What is claimed is:

1. A medium processing apparatus comprising:

a processing unit that performs processing on a sheet-like medium;

an outer wall on which a discharge port, from which the medium processed by the processing unit is discharged, is open;

a stacking portion that has a stacking surface on which the medium discharged from the discharge port is stacked;

a suction unit that sucks air on the stacking surface via a suction port provided below the discharge port; and a control unit that controls a workload of the suction unit to reduce the workload of the suction unit according to a decrease of an open area of the suction port caused by the occlusion of the suction port by the stacked medium on the stacking portion, the open area being compared against one or more predetermined threshold values, the one or more predetermined threshold values specifying a desired workload for the suction unit, the workload of the suction unit being decreased when the open area exceeds the one or more predetermined threshold values.

2. The medium processing apparatus according to claim 1, wherein the suction port is open to the stacking surface.

3. The medium processing apparatus according to claim 2, wherein the control unit increases the workload of the suction unit based on an increase in a stacking height of the medium stacked on the stacking portion.

4. The medium processing apparatus according to claim 1, wherein the suction port is open to the outer wall.

5. The medium processing apparatus according to claim 4, wherein a plurality of the suction ports are provided as slit-shaped openings extending in a upward and downward direction, and the control unit reduces the workload of the suction unit according to the open area of the suction port which is decreased by occluding a part of each of the plurality of suction ports by the medium stacked on the stacking portion.

6. The medium processing apparatus according to claim 4, wherein a plurality of the suction ports are provided as openings arranged in a upward and downward direction, and the control unit reduces the workload of the suction unit according to the open area of the suction port which is decreased by occluding a part of the plurality of suction ports by the medium stacked on the stacking portion.

7. The medium processing apparatus according to claim 1, further comprising:

a side wall that extends continuously from the outer wall and the stacking portion, wherein the suction port is open to the side wall.

8. The medium processing apparatus according to claim 1, further comprising:

a detection unit capable of detecting a stacking amount of the medium stacked on the stacking portion, wherein the control unit changes the workload of the suction unit based on detection of the detection unit.

9. The medium processing apparatus according to claim 1, wherein the control unit is capable of counting the number of discharged media discharged from the discharge port and changes the workload of the suction unit based on the number of the discharged media.

10. The medium processing apparatus according to claim 1, further comprising:

a blowing unit that blows air sucked by the suction unit, wherein the blowing unit blows the air from above the discharge port toward the stacking surface.

11. The medium processing apparatus according to claim 1, wherein the control unit changes the workload of the suction unit based on a size of the medium discharged from the discharge port.

12. The medium processing apparatus according to claim 1, wherein the processing unit is a recording unit that performs recording on the medium.

* * * * *